United States Patent [19]

Phaal et al.

[11] Patent Number: 5,054,246

[45] Date of Patent: Oct. 8, 1991

[54] ABRASIVE COMPACTS

[76] Inventors: Cornelius Phaal, 45 Main Street, Johannesburg, Transvaal; Nicholas Mastrantonis, 2 Kelvin Avenue, Highway Gardens Ext 1, Edenvale, Transvaal, both of South Africa

[21] Appl. No.: 404,085

[22] Filed: Sep. 7, 1989

[30] Foreign Application Priority Data

Sep. 9, 1988 [ZA] South Africa ..... 88/6730

[51] Int. Cl.[5] ..... B24D 7/00

[52] U.S. Cl. ..... 51/204; 51/307; 51/309; 407/118; 125/39; 76/DIG. 12

[58] Field of Search ..... 51/204 R, 307, 309, 51/293, 297; 407/118; 175/329, 410; 125/39; 76/DIG. 12

[56] References Cited

U.S. PATENT DOCUMENTS

| | | | |
|---|---|---|---|
| 4,588,753 | 12/1985 | Barr | 175/329 |
| 4,592,433 | 6/1986 | Dennis | 175/329 |
| 4,606,418 | 8/1986 | Thompson | 175/410 |
| 4,629,373 | 12/1986 | Hall | 51/307 |
| 4,784,023 | 11/1988 | Dennis | 175/329 |
| 4,802,539 | 2/1989 | Hall | 175/329 |
| 4,872,520 | 10/1989 | Nelson | 175/410 |

*Primary Examiner*—Robert A. Rose

*Attorney, Agent, or Firm*—Scully, Scott, Murphy & Presser

[57] ABSTRACT

An abrasive compact is provided which has a plurality of recesses which may take the form of grooves or holes formed in a major surface thereof. The recesses contain no solid material and serve as crack arrester formations.

15 Claims, 2 Drawing Sheets

ABRASIVE COMPACTS

BACKGROUND OF THE INVENTION

This invention relates to abrasive compacts.

Abrasive compacts are used extensively in cutting, milling, grinding, drilling and other abrasive operations. Abrasive compacts consist of a mass of diamond or cubic boron nitride particles bonded into a coherent, polycrystalline hard conglomerate. The abrasive particle content of abrasive compacts is high and there is an extensive amount of direct particle-to-particle bonding. Abrasive compacts are generally made under elevated temperature and pressure conditions at which the abrasive particle, be it diamond or cubic boron nitride, is crystallographically stable.

Abrasive compacts tend to be brittle and in use they are frequently supported by being bonded to a cemented carbide substrate or support. Such supported abrasive compacts are known in the art as composite abrasive compacts. The composite abrasive compact may be used as such in the working surface of an abrasive tool.

Examples of composite abrasive compacts can be found described in U.S. Pat. Nos. 3,745,623, 3,767,371 and 3,743,489.

Composite abrasive compacts are generally produced by placing the components, in powdered form, necessary to form an abrasive compact on a cemented carbide substrate. This unbonded assembly is placed in a reaction capsule which is then placed in the reaction zone of a conventional high pressure/high temperture apparatus. The contents of the reaction capsule are subjected to suitable conditions of elevated temperature and pressure.

Diamond abrasive compacts of the type described in the above mentioned U.S. patent specifications tend to be thermally sensitive and degrade when exposed to temperatures in excess of 700° C. Diamond abrasive compacts are known which are thermally stable at temperatures well in excess of 700° C. and these compacts are known as thermally stable diamond compacts. Examples of such compacts are described in British Patent No. 2158086 and U.S. Pats. Nos. 4,224,380 and 4,534,773.

As mentioned above, abrasive compacts are used in a variety of applications such as cutting, drilling, grinding and in mining picks. In some of these applications large abrasive compacts are used and this gives rise to spalling problems. Spalling occurs when cracks develop in or behing the cutting edge or point due to the large forces which act on that point or edge and the cracks propogate through the compact layer.

U.S. Pat. No. 4,525,179 describes a method of making a diamond or cubic boron nitride compact by providing partitions within the particulate mass which is placed in the high pressure/high temperature apparatus. The material of the strips is typically a metal of Group IIIB, IVB, VB, VIB, VIIB or VII or an alloy thereof. After sintering the partition layers are removed by leaching which will also remove the metallic phase present in the compact. What is produced is a plurality of smaller compacts of various shapes.

This specification also states that the embedded partition strips may remain in the sintered mass and serve as chip arresters which limit the movement of fractures within the diamond or cubic boron nitride compact. However, such compacts, depending on the nature of the material of the partition strip, are likely to be particularly temperature sensitive.

SUMMARY OF THE INVENTION

The invention provides an abrasive compact which has major surfaces on each of opposite sides thereof, one of the major surfaces providing a cutting edge or point, and at least one recess formed in the surface which provides the cutting edge or point and containing no solid material. The term "no solid material" means that the recesses do not contain any metal or other solid material, except perhaps in trace amounts only.

Further according to the invention, a method of making such an abrasive compact includes the steps of providing an abrasive compact having major surfaces on each of opposite sides thereof, one of the major surfaces providing a cutting edge or point, and forming at least one recess in the surface of the compact which provides the cutting edge or point.

DESCRIPTION OF EMBODIMENTS

Figure 1:
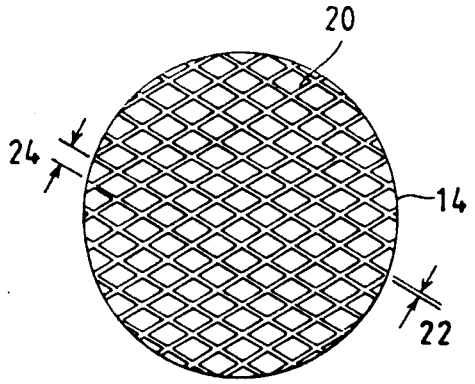
FIG. 1 illustrates a plan view of one embodiment of the invention.

The recess or recesses will be such that they are capable of acting as crack arresters, i.e. they have the ability to minimise propagation of cracks formed in the major surface of the compact which provides the cutting point or edge. The empty recess or recesses form more effective crack arresters than do ones filled with metal or other solid material.

There will generally be a plurality of spaced recesses. These recesses may be holes. The holes may be provided in a random arrangement or in the form of a regular pattern. The holes may cover a part only of the major surface, or extend across the entire major surface, in which they are formed.

The holes will typically be arranged in a series of parallel rows, the holes in one row being either staggered relative to the holes in an adjacent row or in register with the holes in an adjacent row.

The holes will preferably have a small cross section, typically having a diameter of less than 0.5 mm.

The recesses may also be grooves. These grooves will typically be provided in the form of a grid-like pattern which may cover a part of the major surface only, or extend across the entire major surface, in which they are formed. The width of each groove will preferably be small, typically being less than 0.5 mm.

When one recess only is provided, the recess will generally take the form of a groove, at least a portion of which is located close to, e.g. within 1.5 mm of, the cutting edge or point.

The abrasive compact is preferably provided with a cemented carbide support which is bonded to the major surface which does not provide the cutting edge or point. In this form of the invention the abrasive compact will be a composite abrasive compact.

The holes or grooves may extend into the compact to a depth which is half or less than the distance between the two major surfaces. Alternatively, when the abrasive compact is bonded to a cemented carbide support the holes or grooves can extend from one major surface of the compact to the other.

The abrasive compact will preferably be a diamond abrasive compact or PCD as it is also known. The diamond abrasive compact may be one which has a second phase containing a diamond solvent/catalyst and thus be sensitive to temperatures above 700° C. Examples of such diamond compacts are described in U.S. Pat. No. 3,745,623. The diamond compact may also be one which is thermally stable in the sense that it can withstand temperatures of the order of 1200° C. in a vaccum or non-oxidising atmosphere. Examples of such compacts are described in British Patent No. 2158086 and U.S. Pat. Nos. 4,244,380 and 4,534,773. The invention has particular application to a diamond abrasive compact of the type described in this British patent, alone or bonded to a cemented carbide support.

Spalling is a problem which manifests itself particularly with large abrasive compacts, i.e. compacts wherein the major surface providing the cutting edge has a linear dimension, such as a diameter in the case of a disc-shaped compact, of at least 30 mm.

The abrasive compacts of the invention will be made by first making the compact in a high pressure/high temperature apparatus in the conventional way. The compact is removed from this apparatus and the recesses thereafter formed in the relevant surface. The recesses may be formed in this surface by laser cutting, spark erosion or like method. The recesses are thus formed in the relevant surface in a post-sintering step.

The abrasive compacts of the invention may be used in a variety of appliccations, but have particular application in mining picks and rotary drill bits. For such applications they may be used as such or they may be bonded to a suitable elongate pin and used in this supported manner. The use of abrasive compacts in these applications is well known.

Figure 2:
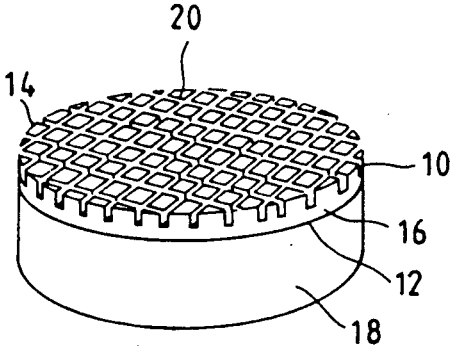
FIGS. 2 and 3 illustrate perspective views of two forms of the embodiment of FIG. 1.
Figure 3:
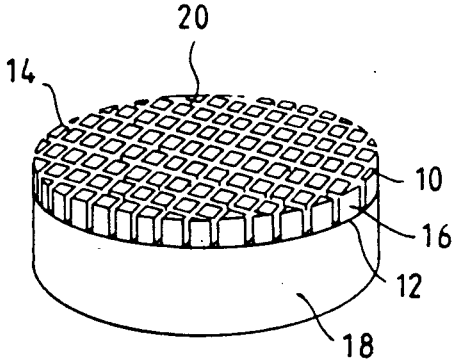

Various embodiments of the invention will now be described with reference to the accompanying drawings. Referring first to FIGS. 1 to 3, there is shown an abrasive compact of disc shape which has major surfaces 10, 12 on each of opposite sides thereof. The edge 14 of the surface 10 provides the cutting edge. The compact has a side surface 16. Bonded to the major surface 12 is a cemented carbide support 18. This support 18 is also of disc shape andd has a substantially greater mass than that of the compact.

A plurality of grooves 20 are formed in the surface 10 of the compact. These grooves 20 form a grid-like pattern extending across the entire surface 10, as indicated by FIG. 1. The width 22 of each groove is about 0.3 mm and the spacing 24 between adjacent grooves is about 1.5 mm.

The grooves 20 extend partially into the compact from the surface 10, as illustrated by FIG. 2. Alternatively, the grooves 20 may extend from the one major surface 10 to the other major surface 12, as illustrated by FIG. 3.

Figure 4:
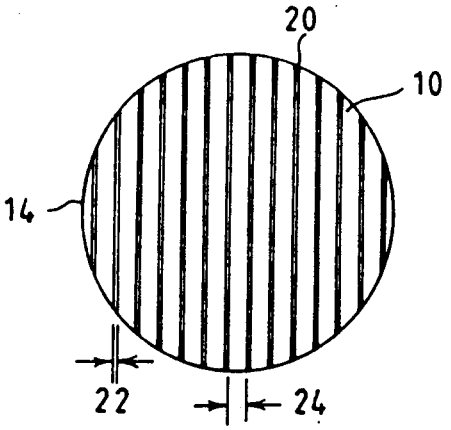
FIGS. 4 to 9 illustrate plan views of six other embodiments of the invention.
Figure 5:
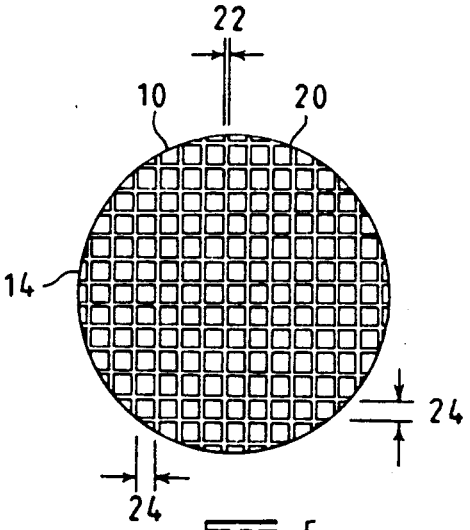

FIGS. 4 and 5 illustrate plan view of supported abrasive compacts similar to that of FIGS. 1 to 3. Like parts carry like numerals. In the embodiment of FIG. 4 a plurality of evenly spaced grooves 20 are provided which extend across the surface 10. In the embodiment of FIG. 5 the grooves 20 are provided in the form of a rectangular grid-like pattern.

Figure 6:
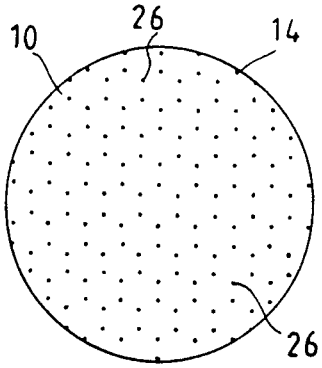

The embodiment of FIG. 6 is similar to that of FIGS. 1 to 3, save that the crack arrester recesses take the form of a plurality of holes 26 in the surface 10. These holes 26 are randomly distributed across the surface 10. The holes may extend partially only into the compact from the surface 10 or extend from one major surface to the other. The holes will typically have a diameter of about 0.3 mm and the distance between adjacent holes will generally be not less than 1.5 mm.

Figure 7:
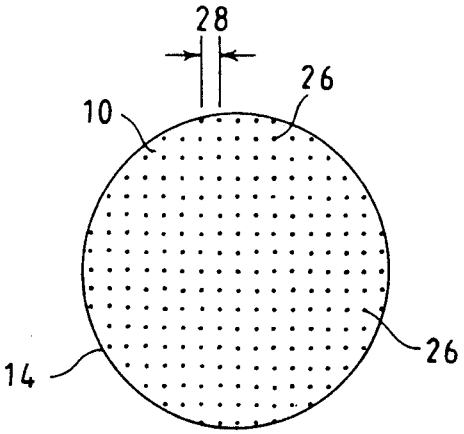
Figure 8:
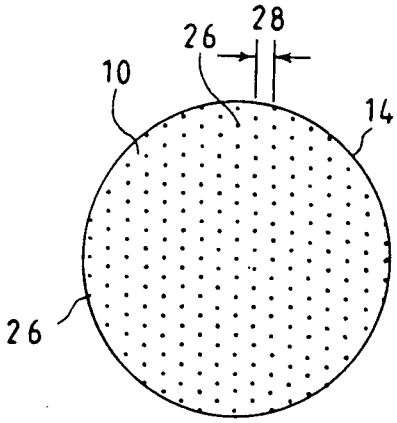

The embodiments of FIGS. 7 and 8 are similar to that of FIG. 6 and like parts carry like numerals. The holes in the FIG. 7 embodiment arranged in a series of parallel rows, with the holes in one row being in register with the holes of an adjacent row. The distance 28 between adjacent rows will typically be of the order of 1.5 mm. In the FIG. 8 embodiment, the holes are again provided in the form of a series of parallel rows, but with the holes in one row being staggered relative to the holes in an adjacent row. The distance between adjacent rows will also be of the order of 1.5 mm.

Figure 9:
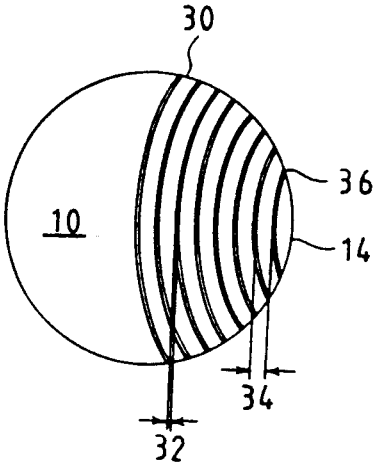

FIG. 9 illustrates a further embodiment of a composite abrasive compact in which the crack arrester recesses take the form of a plurality of arc-shaped grooves 30 formed in the surface 10 of the compact. These arc-shaped grooves are evenly spaced and extend across a portion of the surface 10. Each groove has a width 32 of about 0.3 mm and the spacing 34 between adjacent grooves is about 1.5 mm. In an alternative form of this embodiment, one groove only is provided. This groove will be the groove 36.

In each of the above embodiments, the composite compacts were first made by methods well known in the art and as illustrated by the various patents discussed above. Thereafter, the grooves or holes were formed in the relevant surface of the compact by laser cutting or spark erosion.

We claim:

1. An abrasive compact which has major surfaces on each of opposite sides thereof and a plurality of recesses formed in one of the major surfaces thereon which provides a cutting means, the recesses being less than 0.5 mm in width and containing no solid material, wherein the cutting means are a cutting edge or point.

2. An abrasive compact according to claim 1 in which a plurality of spaced recesses are formed in the surface of the compact which provides the cutting means.

3. An abrasive compact according to claim 2 wherein the recesses are holes.

4. An abrasive compact according to claim 3 wherein the holes are provided in a random arrangement covering at least a part of the major surface in which they are formed.

5. An abrasive compact according to claim 3 wherein the holes are provided in the form of a regular pattern covering at least a part of the major surface in which they are formed.

6. An abrasive compact according to claim 5 wherein the holes are arranged in a series of parallel rows, the holes in one row being staggered relative to the holes in an adjacent row.

7. An abrasive compact according to claim 5 wherein the holes are arranged in a series of parallel rows, the holes in one row being in register with the holes in an adjacent row.

8. An abrasive compact according to claim 2 wherein the recesses are grooves.

9. An abrasive compact according to claim 8 wherein the grooves are provided in a grid-like pattern which covers at least a part of the surface of the compact which provides the cutting means.

10. An abrasive compact according to claim 1 wherein the recess is a single groove, at least a portion of which is located close to the cutting edge or point.

11. An abrasive compact according to claim 1 which is a diamond abrasive compact.

12. An abrasive compact according to claim 1 which is provided with a cemented carbide support bonded to the major surface which does not have said recess formed therein.

13. An abrasive compact according to claim 1 wherein at least one recess extends into the compact to a depth of about one-half to less than one-half the distance between the major surfaces.

14. A mehtod of making an abrasive compact according to claim 1 includes the steps of providing an abrasive compact having major surfaces on each of opposite sides thereof, one of the major surfaces providing a cutting edge or point, and forming at least one recess in the surface of the compact which provides the cutting edge or point.

15. A method according to claim 14 wherein the at least one recess is formed in the compact by laser cutting or spark erosion.

* * * * *